United States Patent [19]

Paton et al.

[11] 4,297,946

[45] Nov. 3, 1981

[54] EXTENDED SHAPED CHARGE AND METHOD OF MAKING SAME

[76] Inventors: Boris E. Paton, ulitsa Chkalova, 41-a, kv. 26; Vladimir M. Kudinov, ulitsa Filatova, 1/22, kv. 51; Leonid A. Volgin, ulitsa Erevanskaya, 14 g, kv. 33; Vladimir G. Petushkov, ulitsa Pugacheva, 19a, kv. 6; Jury P. Bushtedt, bulvar Likhacheva, 3, kv. 7; Anatoly Y. Koroteev, Sapernoe pole, 9/21, kv. 27; Viktor A. Kotov, Goloseevo, 3, kv. 7, all of Kiev, U.S.S.R.

[21] Appl. No.: 966,642

[22] Filed: Dec. 5, 1978

[51] Int. Cl.[3] ..... C06C 7/02; F42B 3/08; C06B 21/00

[52] U.S. Cl. ..... 102/307; 102/476; 264/3 A

[58] Field of Search ..... 102/24 HC, 56 SC; 264/3 A, 3 B; 86/47

[56] References Cited

U.S. PATENT DOCUMENTS

| | | | |
|---|---|---|---|
| 2,605,704 | 8/1952 | Dumas | 102/24 HC |
| 2,766,507 | 10/1956 | Farber et al. | 102/56 SC X |
| 3,165,057 | 1/1965 | Armstrong | 102/24 HC |
| 3,176,613 | 4/1965 | Godfrey et al. | 102/24 HC |
| 3,251,300 | 5/1966 | Reyne | 102/24 HC |
| 3,777,663 | 12/1973 | Brown | 102/24 HC |

FOREIGN PATENT DOCUMENTS

| | | | |
|---|---|---|---|
| 2428435 | 10/1975 | Fed. Rep. of Germany | 102/24 HC |

*Primary Examiner*—Richard D. Lovering
*Attorney, Agent, or Firm*—Fleit & Jacobson

[57] ABSTRACT

An extended shaped charge comprises a tubular body of a one-piece construction with a convexo-concave profile, having thinner portion of its wall on the side of a charge hollow. The profile of the tubular body is formed by conjugate sections of two closed curves having a common symmetry axis and being internally tangent at the point lying on this axis. In a specific case the closed curves are circles.

11 Claims, 12 Drawing Figures

EXTENDED SHAPED CHARGE AND METHOD OF MAKING SAME

FIELD OF THE INVENTION

The present invention relates to metal processing by explosion and in particular, to extended shaped charges. It may be used for cutting metal products and work pieces by explosion.

BACKGROUND OF THE INVENTION

Penetrating capability of the perforating jet i.e. the maximum possible depth of penetration thereof and, in particular, the maximum possible depth of cutting, depends on the shape of the charge hollow, thickness of the layer of explosive material over the charge hollow, density of the explosive material and some other factors.

Until quite recently mainly two first above factors were taken into consideration when the design of an extended shaped charge was to be improved. A problem to increase the density of the explosive to be fitted into the cavity of the charge was solved separately without taking account of the charge design.

In the existing extended shaped charges with a conical or curvilinear charge hollow the liner thereof is attached to the outer shell of the charge normally by means of welding, glue or lock joint, and form therewith a cavity filled with an explosive (see, or example, U.S. Pat. Nos. 3,176,613, 3,251,300, 3,777,663). A body assembled from separate pieces makes it easier to form a charge of any desired shape but does not permit the density of an explosive contained in the cavity of the body to be increased.

Known in the art, for example, is an extended shaped charge wherein a convex outer shell and a liner of the charge hollow, concaved towards the outer shell, form a cavity filled with a high explosive. The outer shell of the charge is made of plastic material and has a shape of the cylinder. The liner of the charge hollow is a copper partition fitted inside the cylinder formed by the outer shell, and separating the cavity containing explosive from the charge hollow which is filled with gas in order to ensure a shaped charge effect when the charge is used under water. The liner of the charge hollow has a shape of a cylinder section so that the cavity to receive explosive is defined, in the cross section of the charge, by intersecting circular arcs of the two cylinders (see FRG Pat. No. 2428435, 1975).

The design of the above charge provides for separate manufacture of the outer shell and the liner of the charge hollow, which are subsequently assembled to form a body of the charge. An explosive material fitted into the cavity of the body is formed by casting and has, therefore, voids decreasing the density thereof.

It should be noted that the body of the charge of the above design allows a power explosive material to be used in the charge but the density of such explosive material filled in a loose state is lower (about 1 kg/cm$^3$) than that of the cast explosive. Compacting the powder explosive material during the process of its being filled is a dangerous and expensive additional operation, and, besides, does not produce the desired result (in this way the density of the powder explosive material can be increased not more than to 1.3 kg/cm$^3$, the degree of density being not uniform over the whole length of the charge).

It should be also noted that apart from the above disadvantages of the extended shaped charge in question, the body of the charge, which is assembled from separate components, does not permit the productivity of its manufacture to be considerably raised.

SUMMARY OF THE INVENTION

An object of the present invention is to provide an extended shaped charge of such design which enables penetrating capability of the perforating jet to be increased.

Another object of the present invention is to provide an extended shaped charge the design of which would permit the productivity of its production to be improved.

An object of the invention is, in particular, to provide an extended shaped charge the design of which enables the density of an explosive in the charge to be increased to a maximum.

An object of the invention resides in the provision of an extended shaped charge ensuring a maximum penetrating capability of the perforating jet, obtained with a minimum quantity of an explosive per unit of a charge length.

A further object of the invention is to provide an extended shaped charge with the optimum relationship between the dimensions of a charge hollow and those of a cavity containing explosive material, which would provide a maximum penetrating capability of the perforating jet.

This object is accomplished by that.

The present invention contemplates an extended shaped charge wherein a convex outer shell and a liner of a charge hollow, concaved towards the outer shell, form a cavity filled with an explosive, and wherein, according to the invention, the liner of the hollow charge is made integral with the outer shell, to form a tubular body having a thinner portion of its wall on the side of the charge hollow. A profile of the tubular body has a convex portion shaped to the form of a first curvilinear length and corresponding to the outer shell, and a concaved portion made to the form of a second curvilinear length and corresponding to the liner of the charge hollow, the first and the second curvilinear lengths are portions of a first and a second closed curves having a common symmetry axis and being internally tangent to each other at the same point lying thereon. The first curvilinear length is conjugate with the second curvilinear length so that a width of the charge hollow measured by a chord of the first closed curve between points of intersection thereof with tangents to extreme points of the second conjugate curvilinear length, is not less than a length of a great chord of the second closed curve, normal to the symmetry axis of the profile.

The above design of an extended shaped charge enables formation of a stable perforating jet and permits a penetrating capability thereof to be improved as a result of the density of the explosive material fitted into the cavity of the charge body being increased during manufacture as its tubular body can be manufactured by rolling or drawing of a tubular work piece. Before being shaped through one of the above methods the cavity of the tubular work piece may be filled with a powder explosive material, which permits the density of the explosive material to be increased to a maximum in the process of rolling or drawing, nearly to 1.8 kg/cm$^3$.

It is most expedient to shape the convex portion of the tubular body profile to the form of an arc of the first circle and the concaved portion thereof to the form of an arc of the second circle being internally tangent to the first circle, the arcs of the first and the second circles may be conjugate with each other mainly through straight lengths tangent to the second circle and parallel to the profile symmetry axis passing through the centers of the first and the second circles.

The tubular body of the above configuration is simple in manufacture, compact and economical because the same penetration capability of the perforating jet is achieved with a lesser quantity of an explosive per unit of length of the extended shaped charge as compared with other designs of the charge.

It is also expedient that the width of the charge hollow, equal to the diameter of the second circle be within 40 to 50% of an internal diameter of the tubular body in that portion thereof which corresponds to the convex portion of the profile, which provides the best conditions for formation of a stable perforating jet and a minimum consumption of explosive material per unit of the length of cut.

It is advantageous that the tubular body be constructed of copper which as a material for the liner of the charge hollow is beneficial, owing to its high specific gravity, for improving penetration capability of the perforating jet. In addition a high plasticity of the copper provides favorable conditions for manufacturing a tubular body, ensuring a high degree of its squeezing with a relatively little force of rolling or drawing.

It is further expedient that a wall thickness of the tubular body on the side of the charge hollow constitute from 4 to 7% of the internal diameter of said tubular body in that portion thereof which corresponds to the convex portion of the profile. Relationship between said values affects the penetration capability of the perforating jet and together with other said features of the proposed extended shaped charge ensures optimum penetration capability of its perforating jet.

BRIEF DESCRIPTION OF THE DRAWINGS

The invention will now be explained with reference to an embodiment thereof and accompanying drawing, wherein:

in FIG. 2 by two similar closed curves having a common symmetry axis and different radii of curvature, in FIG. 3 by similar ellipses, in FIG. 4 by an ellipse and a circle in FIG. 5 by a circle and an ellipse, in FIGS. 6, 7 by two ellipses oriented in different directions.

in FIG. 8 with a straight longitudinal axis, in FIG. 9 with a curvilinear longitudinal axis curved in a horizontal plane, in FIG. 10 with a curvilinear longitudinal axis curved in a vertical plane.

DETAILED DESCRIPTION OF THE INVENTION

Figure 1:
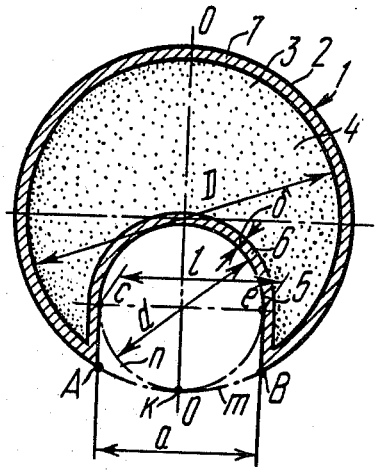
FIG. 1 is a cross-section of the extended shaped charge according to the preferred embodiment of the present invention.

An extended shaped charge comprises a tubular body 1 (FIG. 1) having a convexo-concave profile. A wall 2 of said tubular body 1 forms a closed cavity 3 filled with a high explosive material 4, and a charge hollow 5 disposed on the exterior side of the concaved portion of the body. A portion of the wall 2 defining the charge hollow 5 and corresponding to the concaved portion of the profile of the tubular body 1 is a liner 6 of the charge hollow 5. The remaining portion of the wall 2 constitutes an outer shell 7. A contour of the outer shell 7 in cross-section of the tubular body 1 is shaped to the form of a first curvilinear length extreme points of which are designated as A and B. A contour of the liner 6 of the charge hollow 7 is shaped to the form of a second curvilinear length extreme points of which are designated as C and e. The first and the second curvilinear lengths are respectively portions of a first and a second closed curves m and n having a common symmetry axis 0-0 and being internally tangent to each other at the point K lying on this axis. In the preferred embodiment of the invention, illustrated in FIG. 1 the closed curves m and n are a first and a second circles respectively, which makes the design of the tubular body compact, technologically feasible and economical. The latter is explained by that with such configuration of the tubular body the quantity of the explosive material 4 required per unit of length of the shaped charge is minimum.

Figure 2:
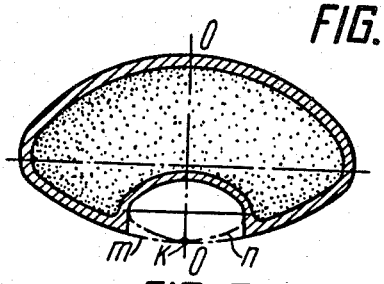
FIGS. 2–7 are cross-sections of other embodiments of the extended shaped charge, according to the invention, wherein the tubular body has a configuration formed.

It is also possible to form a tubular body in which the curves m and n are not circular but represent other forms of closed curves, for example, an ellipse or a curve having a common symmetry axis but different radii of curvature as illustrated in FIG. 2.

Figure 4:
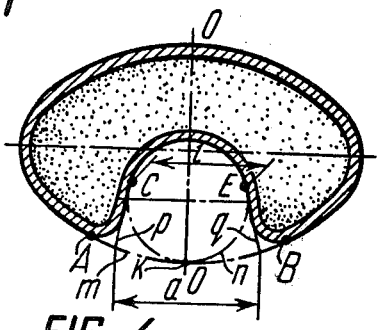
Figure 3:
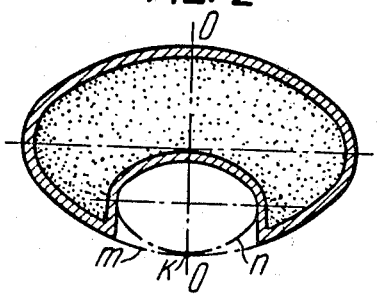
Figure 5:
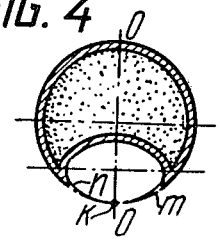
Figure 6:
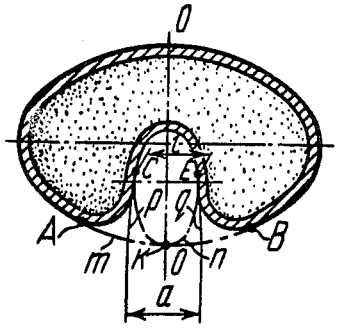
Figure 7:
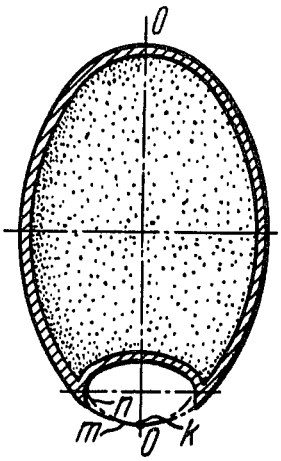

Depending on the predetermined parameters of cutting, such as a depth and width of cutting, and a shape of a work piece to be cut, similar curves may be taken as the first and the second closed curves m and n, respectively, as illustrated in FIGS. 1–3, curves of different configuration as shown in FIGS. 4 and 5, or curves having a different orientation as represented in FIGS. 6, 7.

For all the above cases the first and the second closed curves m and n are internally tangent to each other at the point K lying on their common symmetry axis 0-0, which provides best conditions for manufacturing the tubular body 1 by rolling or drawing with the use of a core element having configuration of the second closed curve. As can be seen from FIGS. 1 to 7, the only contact between the closed curves occurs at the point of internal tangency.

In the preferred embodiment of the invention (FIG. 1) the first curvilinear length /arc/ AB is conjugate with the second curvilinear length /arc/ Ce mainly by straight line lengths AC and Be, respectively, which are parallel to the symmetry axis 0-0. Other forms of the conjugating lengths are also possible. They may be, for example, circular arcs as shown in FIGS. 4 and 6. In a general case the conjugation must comply with the condition $$a \geqq 1,$$

where a is a width of the charge hollow 5, measured by the chord of the first closed curve between the points of intersection thereof with tangents p and q (FIGS. 4 and 6) drawn to the extreme points C and E of the second conjugate curvilinear length, l is a length of the great chord of the second closed curve normal to the symmetry axis 0-0.

Non-observance of this condition may cause unwanted deformation of the perforating jet by the side portions of the liner 6 of the charge hollow 5.

In the embodiment of the invention, illustrated in FIG. 1, a=d, where d is the diameter of the second circle n, since the requirements imposed upon the outer shell 7 and the liner 6 of the charge hollow 5 are different as regards their capability to absorb the shock wave energy. The wall thickness of the tubular body in said parts thereof is different, namely, the thickness of the liner of the charge hollow 5 is less than that of the outer shell 7, which enables the liner 6 to be imparted with a high velocity when the perforating jet is formed.

Figure 8:
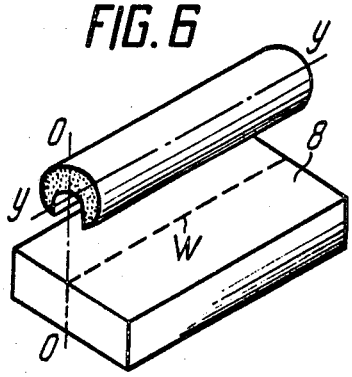
FIGS. 8–10 represent an axonometric view of the extended shaped charges, according to the invention, with longitudinal axis of different shape.
Figure 9:
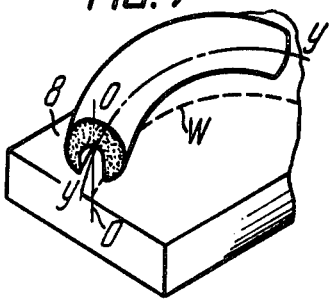
Figure 10:
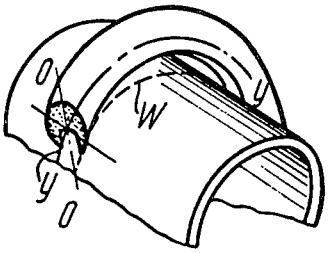

The tubular body 1 has a straight or curved longitudinal axis Y-Y depending on the predetermined configuration of the cutting line W of the work piece 8 (see FIGS. 8–10).

In the preferred embodiment of the invention the tubular body 1 is constructed from copper though it may be made from other materials having sufficient plasticity and being liable to deformation when being rolled or drawn, for example, low-carbon steel or aluminium. Apart from a high plasticity which facilitates manufacture of the tubular body 1 by cold rolling or drawing, the copper has another advantage over other materials, which lies in its high specific gravity increasing a mass of the liner 6 of the charge hollow 5, which, in turn, is beneficial for improving the penetration capability of the perforating jet.

It has been proved by tests that the penetration capability of the perforating jet is affected by the relationship between the volume of the charge hollow and that of the explosive material 4 contained in the cavity of the tubular body 1.

For the tubular body 1 having a shape represented in FIG. 1 the optimum condition is $$40\% \leqq d/D \leqq 50\%$$

where d is a diameter of the second circle n, equal to the width a of the charge hollow 5, and D is a diameter of the cavity 3 of the tubular body 1 in that portion thereof which corresponds to the outer shell 7.

With the relation $d/D > 50\%$ quantity of the explosive is not sufficient to impart a high velocity to the liner 6 of the charge hollow 5 when the perforating jet is formed. With the relation $d/D < 40\%$ a quantity of the explosive turns to be excessive. In either case the quantity of the explosive per unit of length of cutting, to provide the same depth of cutting, will be greater than with d/D values lying within the above limits.

Figure 11:
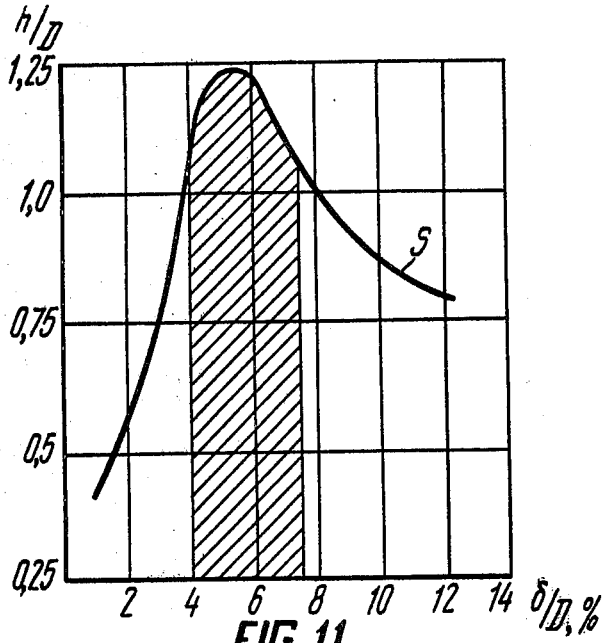
FIG. 11 represents a graph of dependence of the cutting depth from the thickness of the wall of the tubular body on the side of the charge hollow, for the embodiment of the extended shaped charge illustrated in FIG. 1.

One of the important factors having effect on the penetration capability of the perforating jet is the thickness of the liner 6 of the charge hollow 5. The graph in FIG. 11 illustrates dependence of the depth h of cutting by means of the perforating jet from the thickness δ of the liner 6 of the charge hollow 5. Both above values are taken in relationship to the diameter D of the cavity 3. A curve S characterizing said relationship has been reproduced from data received as a result of cutting a steel material by means of the extended shaped charge the tubular body of which was constructed from copper and had a shape represented in FIG. 1, with the condition $$40\% \leqq d/D \leqq 50\%$$

being complied with.

As a high explosive was used the hexogen with a density of 1.72 gm/cm$^3$.

The curve has its distinct maximum at a value δ/D near to 6% .

For an extended shaped charge with other high explosive material, for example, octogen the values of the relation δ/D will be different with the same values of the relation between the depth h of cutting and the diameter D of the cavity 3, but the main characteristics of the curve S will not change. Within a range of values of δ/D when the depth h of cutting exceeds the diameter D of the cavity 3, or equal thereto (see shaded portion on the graph), the penetration capability of the penetrating jet is the maximum. Said portion for the extended shaped charge of said configuration is found within the range $$4\% \leqq \delta/D \leqq 7\%.$$

The high explosive 4 contained in the cavity 3 of the tubular body 1 is hexogen or octogen powder with a density near to 1.8 gm/cm$^3$. Such density can be obtained through manufacturing the charge by rolling or drawing of a tubular work piece preliminary filled with one of said explosives. A high density of the charge explosive ensures a high penetration capability of the perforating jet.

Figure 12:
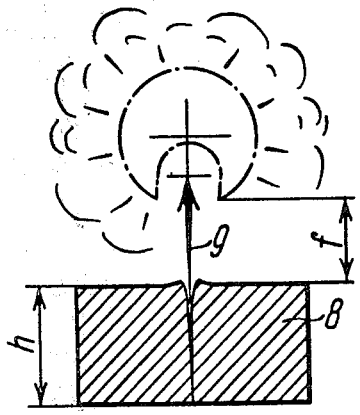
FIG. 12 illustrates a process of formation of the perforating jet when the explosive is detonated, according to the invention.

When the explosive is detonated by blasting means (not shown) disposed along the symmetry axis 0-0 of the tubular body 1 (FIG. 1) the liner 6 of the charge hollow 5 is deformed by the shock wave so that its mass concentrates along the symmetry axis 0-0 of the tubular body 1 to form the perforating jet 9 (FIG. 12) with a wedge-like leading end directed opposite to the charge hollow 5 and moving with a high velocity towards the work piece 8 to be cut. Penetrating into the work piece 8 the perforating jet cuts it. The thickness h of the work piece to be cut is determined depending on the material of the work piece, density of the high explosive 4 contained in the tubular body 1 of the extended shaped charge, relative dimensions of the liner 6 of the charge hollow 5 and the cavity 3, and on the distance f between the tubular body 1 and the work piece 8 being cut.

The extended shaped charge according to the invention, was tested through cutting a steel plate 60 mm thick, the charge being placed over the plate. The copper tubular body had a diameter of 18 mm, thickness of the outer shell of 1.2 mm, the relation d/D=0.42, the relation δ/D=0.055. The hexogen with a density of 1.72 gm/cm$^3$ was employed as a high explosive. The depth of penetration of the perforating jet was 22 mm.

Another extended shaped charge with a copper tubular body having a diameter of 27 mm was filled with the octogen having a density of 1.75 gm/cm$^3$. The relations d/D and δ/D constituted 0.48 and 0.045 respectively. The depth of penetration of the perforating jet was 32 mm.

The test, carried out for the purpose of comparison, of two other extended shaped charges differing from the above charges only by the relation δ/D which was 0.1 for the charge with a diameter of 18 mm, and 0.13 for the charge with a diameter of 27 mm, produced worse results: the penetration depth of the perforating jet of the charge with the diameter of 18 mm was 14.5 mm and that of the charge with the diameter of 27 mm was 22 mm.

Numerous tests have shown that a maximum depth of penetration of the perforating jet into the steel (or a thickness of the work piece to be cut) produced by an extended shaped charge having a tubular body, as shown in FIG. 1, with an external diameter up to 35 mm and numerical values of the relations d/D and δ/D not exceeding the above limits, exceeds the diameter of the charge.

The above extended shaped charge enables a high penetration capability of the perforating jet to be obtained owing both to optimum relationship between the dimensions of the charge hollow and the cavity filled with the explosive matter, and to the possibility provided by its design, to obtain a maximum density of the high explosive fitted into the cavity of the tubular body.

While particular embodiments of the invention have been shown and described, various modifications thereof will be apparent to those skilled in the art, which may be made in the invention without departing from the spirit and scope thereof as defined in the claims.

We claim:

1. An extended shaped charge comprising a high explosive material and a one piece, integral tubular body, a profile of the tubular body having a convex portion shaped to the form of a first curvilinear length and a concaved portion shaped to the form of a second curvilinear length, said tubular body having an integral wall defining a cavity filled with said high explosive material and a charge hollow disposed on an exterior side of the concaved portion of the profile, the wall of said tubular body being thinner on the side of the charge hollow, the first and the second curvilinear lengths being respectively portions of first and second closed curves having a common symmetry axis and being internally tangent to each other at a point lying on said symmetry axis, the only contact between the closed curves being at the point of tangency, the first curvilinear length being conjugate with the second curvilinear length so that the width of the charge hollow measured by a chord of the first closed curve between the points of intersection thereof with tangents to the extreme points of the second curvilinear length being not less than a length of a great chord of the second closed curve normal to the symmetry axis of the profile.

2. An extended shaped change according to claim 1, wherein said tubular body is constructed from copper.

3. An extended shaped charge according to claim 1, wherein the convex portion of the profile of said tubular body is shaped to the form of the arc of a first circle, and the concaved portion of the profile of said body is shaped to the form of an arc of a second circle internally tangent to the first circle, the arcs of the first and the second circles being conjugate with each other substantially by straight lengths tangent to the second circle and parallel to the symmetry axis of the profile, the symmetry axis passing through the centers of the first and the second circles.

4. An extended shaped charge according to claim 3, wherein the width of the charge hollow, corresponding to the diameter of the second circle constitutes from 40 to 50% of an internal diameter of said tubular body in that portion thereof which corresponds to the convex portion of the profile.

5. An extended shaped charge according to claim 1, wherein said convex and concaved portions have ends spaced from each other, the ends being interconnected with each other by portions of the wall of said tubular body.

6. An extended shaped charge according to claim 5, wherein the interconnecting portions of the wall include generally straight portions.

7. An extended shaped charge according to claim 5, wherein the interconnecting portions of the wall include arcuate shaped portions.

8. An extended shaped charge comprising high explosive material and a one piece, integral tubular body constructed of copper, said tubular body having a symmetrical profile with a convex portion shaped to the form of an arc of a first circle and a concaved portion shaped to the form of an arc of a second circle, the second circle having internal tangency with the first circle, the only contact between the two circles being at the point of tangency, the arcs of the first and the second circles being conjugate with each other, substantially, by straight lengths tangent to the second circle and parallel to a symmetry axis of the profile, the symmetry axis passing through the centers of the first and the second circles, said tubular body having an integral wall defining a cavity filled with the high explosive material, and a charge hollow disposed on an exterior side of the concaved portion of the profile, the width of the charge hollow corresponding to the diameter of the second circle constituting from 40 to 50% of the internal diameter of said tubular body in that part thereof which corresponds to the convex portion of the profile and the thickness of the wall of said tubular body on the side of the charge hollow constituting from 4 to 7% of said internal diameter of said tubular body.

9. A method of making an extended shaped charge having a high explosive material contained within a tubular body, the tubular body having a profile with a convex portion shaped to the form of a first curvilinear length and a concaved portion shaped to the form of a second curvilinear length, said tubular body having a wall defining a cavity filled with said high explosive material and a charge hollow disposed on an exterior side of the concaved portion of the profile, the first and the second curvilinear lengths being respectively portions of first and second closed curves having a common symmetry axis and being internally tangent to each other at a point lying on the symmetry axis, the first curvilinear length being conjugate with the second curvilinear length so that the width of the charge hollow measured by a chord of the first closed curve between the points of intersection thereof with tangents to the extreme points of the second conjugate length is not less than a length of a great chord of the second closed curve normal to the symmetry axis of the profile, said method comprising:

filling a tubular member with a high explosive material, the tubular member having a convex portion shaped to the form of a first curvilinear length; and shaping the tubular member with an element having a convex configuration of a second curvilinear length to thereby deform the tubular member and form a shaped charge having high explosive material contained within a tubular body having a profile with a convex portion shaped to the form of the first curvilinear length and a concaved portion shaped by said element to have the form of the second curvilinear length, the concaved portion being shaped so that the closed curves contact each other only at the point of tangency.

10. The method of claim 9, wherein said shaping includes rolling the tubular member.

11. The method of claim 9, wherein said shaping includes drawing the tubular member.

* * * * *